US006264185B1

(12) United States Patent
Isobe et al.

(10) Patent No.: US 6,264,185 B1
(45) Date of Patent: Jul. 24, 2001

(54) SUCTION PAD

(75) Inventors: Kazuo Isobe; Hiroshi Shoda, both of Shizuoka-ken (JP)

(73) Assignee: Shoda Iron Works Co., Ltd. (JP)

( * ) Notice: Subject to any disclaimer, the term of this patent is extended or adjusted under 35 U.S.C. 154(b) by 0 days.

(21) Appl. No.: 09/553,138

(22) Filed: Apr. 19, 2000

(51) Int. Cl.[7] ..... B25B 11/00

(52) U.S. Cl. ..... 269/21; 269/20; 269/309; 294/64.1

(58) Field of Search ..... 269/20, 21; 279/3; 294/64.1; 451/388

(56) References Cited

U.S. PATENT DOCUMENTS 4,828,304 * 5/1989 No et al. ..... 294/2
5,035,409 * 7/1991 Mulliner ..... 269/21
5,048,804 * 9/1991 Ito ..... 269/21
5,344,202 * 9/1994 Ramler ..... 294/64.1
5,738,574 * 4/1998 Tolles et al. ..... 451/288
5,853,169 * 12/1998 Hern et al. ..... 269/21
5,906,363 * 5/1999 Reis et al. ..... 269/21
6,056,825 * 5/2000 Sumnitsch ..... 118/730

FOREIGN PATENT DOCUMENTS 63-208459 8/1988 (JP) .

* cited by examiner

*Primary Examiner*—Joseph J. Hail, III
*Assistant Examiner*—Daniel Shanley
(74) *Attorney, Agent, or Firm*—Harness, Dickey & Pierce, P.L.C.

(57) ABSTRACT

A suction pad (A) is adapted to be placed on a suction table (2) a plurality of openings (2*a*) connected to a negative pressure generating source (3) in order to fix a work piece (W) by suction on a top surface (5*d*) of the suction pad (A). The suction pad (A) includes a communicating passage (5*a*, 5*b*, 5*c* and 6*a*) for communicating the top surface (5*d*) with a bottom surface (6*b*) of the suction pad (A) and for communicating negative pressure from the openings (2*a*) of the suction table (2) to the top surface (5*d*) of the suction pad (A) when the suction pad (A) is placed on any one of the openings (2*a*) of the suction table (2). A magnet (10) is provided for attracting a plug (4) for normally closing each of the openings (2*a*) of the suction table (2) so as to communicate the negative pressure generating source (3) with the communicating passage (5*a*, 5*b*, 5*c* and 6*a*).

6 Claims, 4 Drawing Sheets

(a)

(b)

SUCTION PAD

BACKGROUND OF THE INVENTION

1. Field of the Invention

The present invention relates to a suction pad adapted to be placed on a suction table of a machine tool for sucking and fixing a work piece.

2. Description of Background Art

The suction table of the machine tool used to position and fix a work piece such as a plank by sucking the work piece on a plurality of openings communicated with negative pressure generating means. In order to avoid the interference between cutting tools such as cutters and the suction table, suction pads are usually placed on the suction table to suck and fix the work piece. That is, the interference between the cutting tools and the suction table can be prevented by interposing the suction pads between the work and the suction table in order to form a space therebetween.

The suction pad of the prior art is connected to a suction hose also connected to the negative pressure generating means (one connected to the suction table or another one separately provided) to generate the negative pressure on the top surface of the suction pad for sucking and fixing the work piece thereon. The fixation of the suction pad to the suction table is carried out by using bolts or by fitting a portion of the suction pad to a guide portion formed in the suction table.

In such structure of the suction pad of the prior art, the working efficiency is lowered because of its requirement of additional cumbersome operations for preventing the twist or tangle of the suction hose connected to the suction pad during its fixation to the suction table as well as the mounting position of the suction pad is limited in a particular point defined by the bolt bores or the guide portion.

SUMMARY OF THE INVENTION

It is, therefore, an object of the present invention to provide a suction pad which can be easily fixed to the suction table at any desirable position on the suction table without using any connecting means such as the suction hose which would cause troubles such as twist or tangle thereof.

According to claim 1 of the present invention, there is provided a suction pad adapted to be placed on a suction table formed therein a plurality of openings connected to a negative pressure generating means and also to be able to suck and fix a work piece placed on a top surface of the suction pad characterized in that the suction pad comprises a communicating passage for communicating said top surface with a bottom surface of the suction pad to be placed on a top surface of the suction table and for leading the negative pressure generated by the negative pressure generating means and applied to the openings of the suction table to the top surface of the suction pad when the suction pad is placed on any one of the openings of the suction table; and a magnet for attracting a plug for normally closing each of the openings of the suction table to open the opening so as to communicate the negative pressure generating means with the communicating passage.

According to this structure, it is possible to apply the negative pressure onto the work piece placed on the top surface of the suction pad by connecting the communication passage to the negative pressure generating means via the plug within the opening attracted by the magnet when the suction pad is placed on any position on the suction table.

Since the negative pressure also acts to suck and fix the suction pad onto the suction table, it is possible to eliminate any fixing means such as bolts or guiding means.

According to claim 2 of the present invention, said plug is a steel ball.

According to claim 3 of the present invention, there is arranged a suction actuating pin at the open end of the communicating passage at the side of the top surface, the suction actuating pin is adapted to close the communicating passage when the work piece is not placed on the top surface of the suction pad and to open the communicating passage when the work piece is placed on the suction pad.

According to this structure, it is possible to actuate the suction pad by connecting the communicating passage to the negative pressure generating means only when the work piece is placed on the suction pad.

According to claim 4 of the present invention, said magnet is a permanent magnet.

According to claim 5 of the present invention, a top surface of the suction table is made of steel.

According to this structure, it is possible to more securely fix the suction pad to the suction table with the aid of the attractive force of the magnet of the suction pad acting on the steel top surface of the suction table in addition to the suction force acting between the suction pad and the suction table.

According to claim 6 of the present invention, the suction pad is formed by an upper member of wood or plastics and a lower member of metal.

BRIEF DESCRIPTION OF THE DRAWINGS

Preferred embodiments of the present invention will be described with reference to the accompanied drawings in which;

FIG. 1 (*b*) is a perspective view showing the top side of the suction pad of the present invention;

DESCRIPTION OF THE PREFERRED EMBODIMENTS

There is shown as one example a wood working router machine 1 to which a suction pad A of the present invention is applied. The machine 1 comprises mainly a suction table 2 for positioning and fixing a work piece W such as a plank, a bed la for slidably supporting the suction table 2 fore and aft, a bottom frame 1*b* adapted to be placed on a floor, post frames 1*c* arranged at either sides of the suction table 2, a column 1*d* supported on the post frames 1*c* and arranged above the suction table 2, a slider 1*e* slidably supported on the column 1*d* laterally along guide faces of the column 1*d*, and spindle heads 1*f* slidably supported in a vertical direction on the slider 1*e* for carrying out cutting operation against the work piece W.

A suction pad A is interposed between the work piece W and the suction table 2 to form a space therebetween so as to avoid interference of a cutter 1*g* mounted on the spindle head if against the suction table 2 during cutting operation on the wood working router machine 1. The suction pad A will be hereinafter described more in detail.

Figure 3:
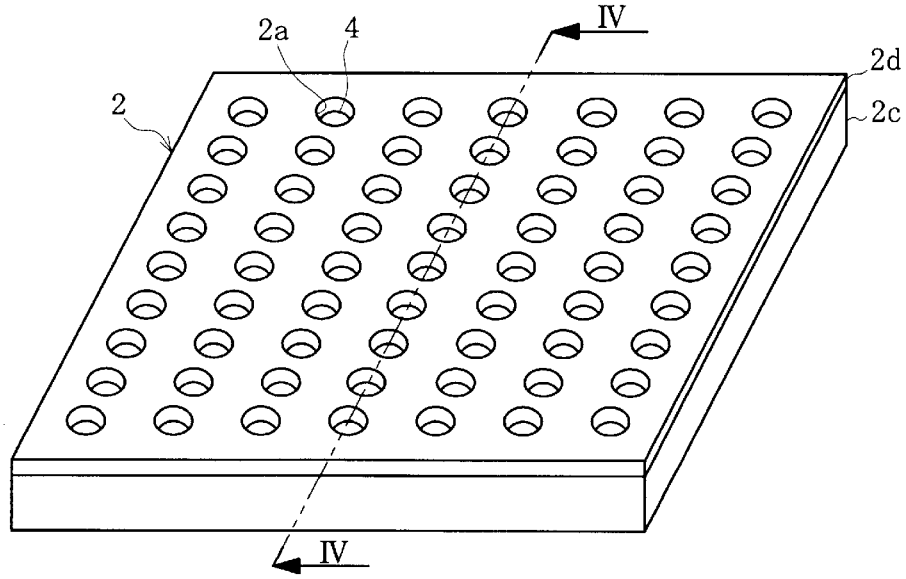
FIG. 3 is a perspective view showing the suction table for sucking the suction pad of the present invention.
Figure 4:
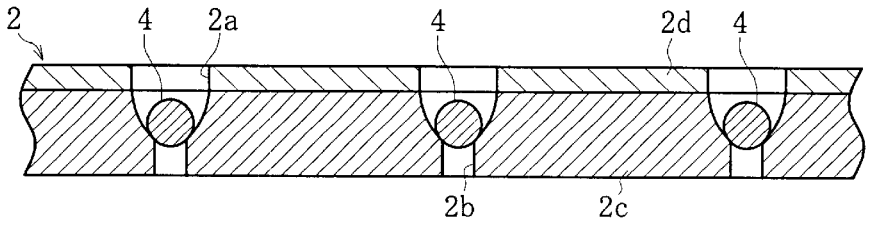
FIG. 4 is a cross-sectional view taken along a line IV—IV in FIG. 3.

As shown in FIGS. 3 and 4, the suction table 2 is formed with a plurality of openings 2*a* communicated with a negative pressure generating means 3 via a suction duct 2*b*. Each opening 2*a* contains therein a steel ball 4 serving as a plug for closing the open end of the suction duct 2*b* as shown in FIG. 4. The suction table 2 comprises a non-magnetic member 2*c* such as a bakelite plate and a steel plate 2*d* arranged on the non-magnetic member 2*c*.

Figure 1:
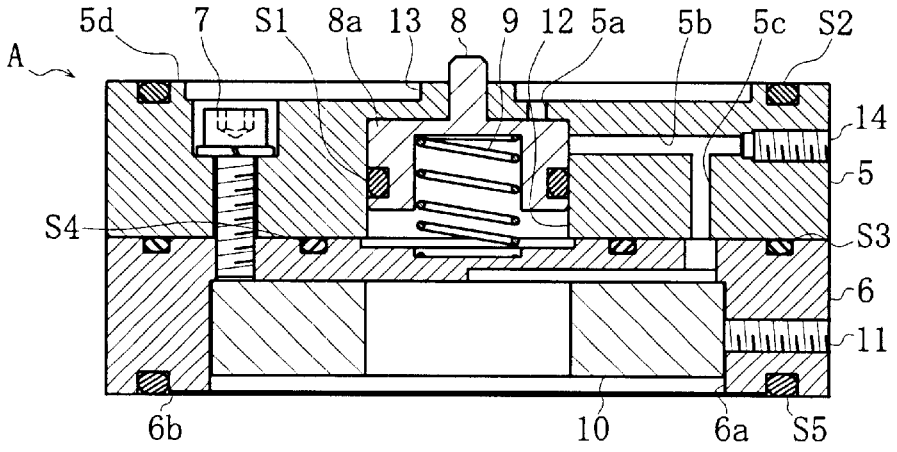
FIG. 1 (*a*) is a cross-sectional view showing the suction pad of the present invention.
Figure 1:
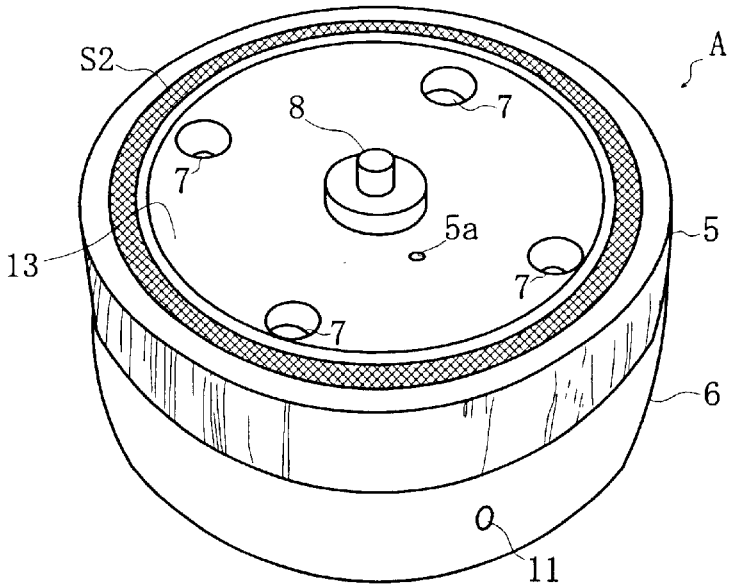

The suction pad A of the present invention is adapted to be placed on the suction table 2 and comprises an upper member 5 made of wood or plastics and a lower member 6 made of metal, which members 5 and 6 are assembled to a unit by bolts 7 as shown in FIGS. 1 (*a*) and 1 (*b*).

The upper member 5 contains a suction actuating pin 8 having an integrally formed barrel portion 8*a*. The barrel portion 8*a* is slidably arranged within a bore 12 formed in the upper member 5 and is always urged upward by a spring 9 so that the suction actuating pin 8 is projected from a top surface 5*d* of the upper member 5. The peripheral surface of the barrel portion 8*a* is provided with an O-ring S1 to seal against the bore 12.

Figure 5:
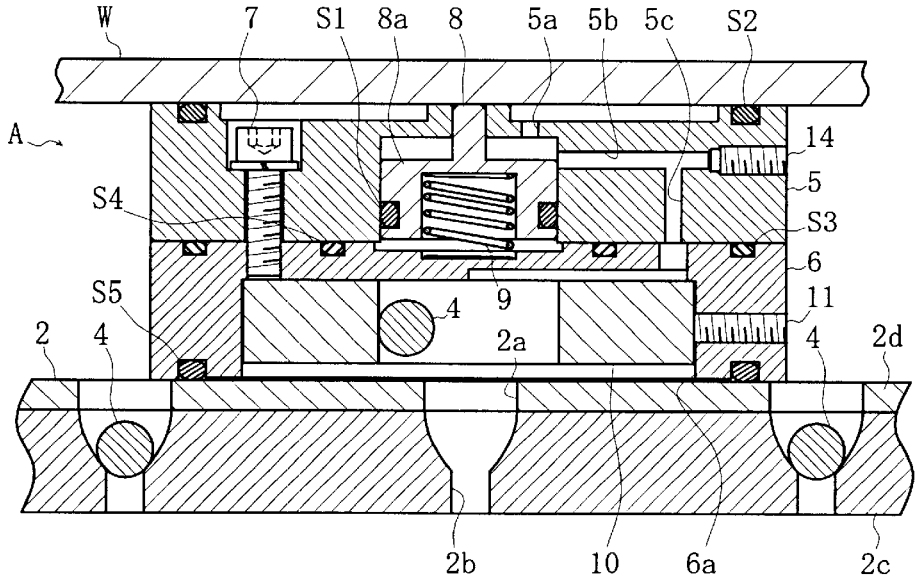
FIG. 5 is a cross-sectional view showing a condition in which the suction pad is fixed on the suction table and a work piece is sucked onto the suction pad.
Figure 6:
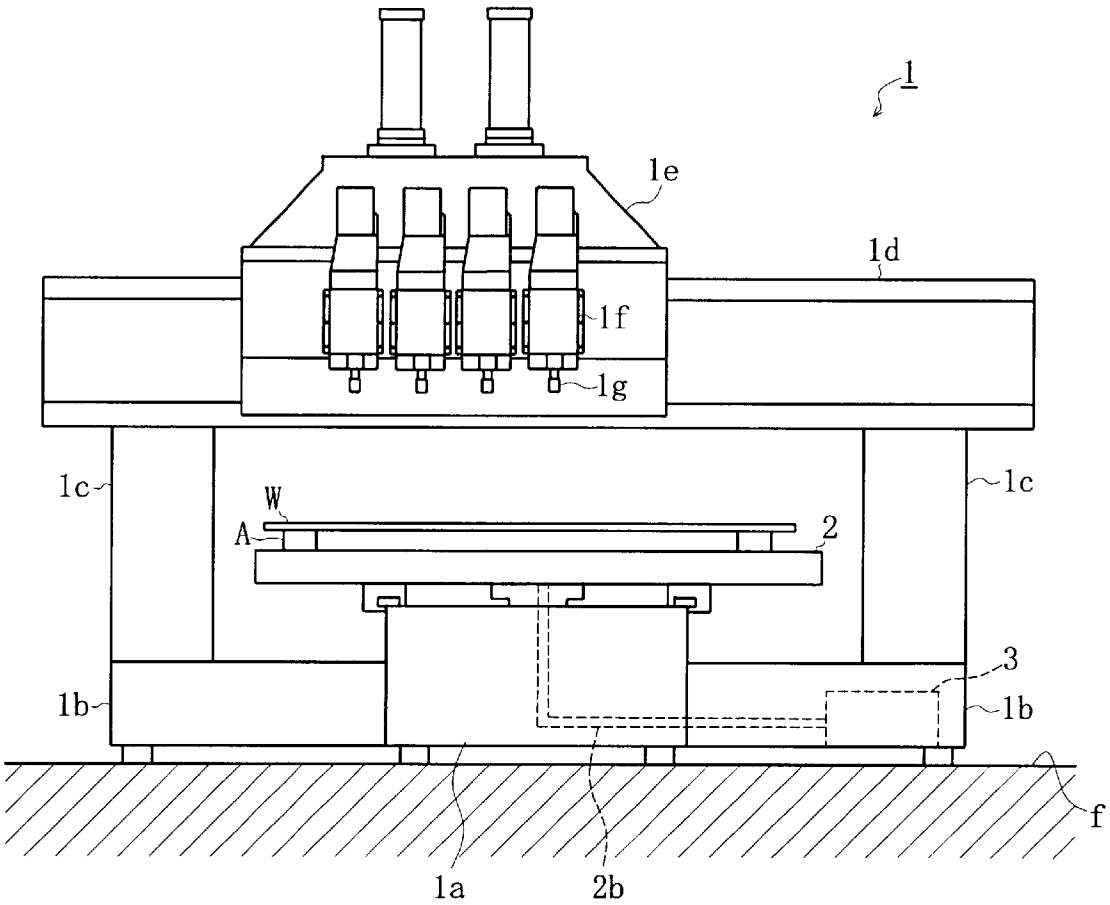
FIG. 6 is a front elevational view showing a wood working router machine to which the suction pad of the present invention is applied.

When the suction actuating pin 8 is situated at a projected position urged upward by the spring 9 as shown in FIG. 1 (*a*), a top-side opening 5*a* as well as a horizontal suction passage 5*b* are closed by the barrel portion 8*a*. On the contrary, when the suction actuating pin 8 is situated at a retracted position pushed downward by the work piece W as shown in FIG. 5, the top-side opening 5*a* as well as the horizontal suction passage 5*b* are opened by the barrel portion 8*a*. The horizontal suction passage 5*b* extends to the peripheral surface of the upper member 5 and is sealed there by a bolt 14 using sealant.

The top surface 5*d* is formed with a relatively shallow recess 13 and an O-ring S2 is arranged at the periphery of the recess 13. This structure provides a wide suction area and makes it possible to increase the sucking force acting against the work piece W placed on the suction pad as shown in FIG. 5.

Figure 2:
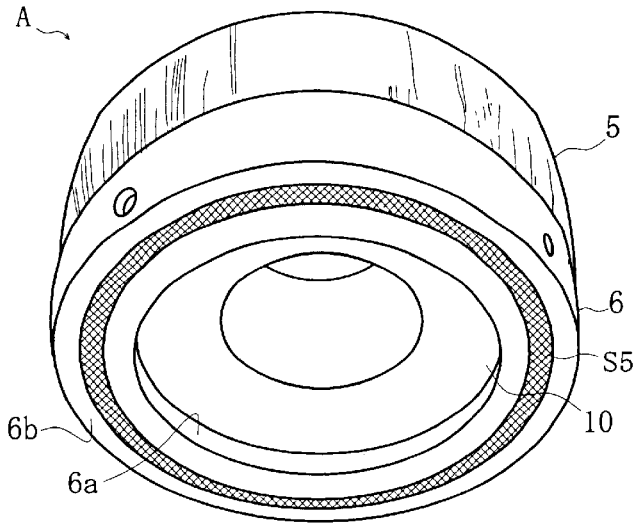
FIG. 2 is a perspective view showing the bottom side of the suction pad of the present invention.

The lower member 6 is formed with a bottom-side opening 6*a* opened to the bottom surface 6*b* of the lower member 6 and connected to a vertical suction passage 5*c* formed within the upper member 5. An annular permanent magnet 10 is contained within the bottom-side opening 6*a* of the lower member 6 and is secured therein by a bolt 11 threaded through the periphery of the lower member 6. The magnet 10 can attract the steel ball 4 within the opening 2*a* of the suction table 2 into the central bore of the magnet 10 when the suction pad A is placed on the opening 2*a* of the suction table 2 as shown in FIG. 5. FIG. 2 clearly shows the condition of the magnet 10 mounted within the bottom-side opening 6*a*.

The top-side opening 5*a*, the horizontal passage 5*b*, vertical passage 5*c* and the bottom-side opening 6*a* establish a communication passage between the top surface 5*d* and the bottom surface 6*b* of the suction pad A. The communication passage leads the negative pressure from the negative pressure generating means 3 to the top surface 5*d* when the work piece W is placed on the suction pad A positioned on the opening 2*a* of the suction table 2. Reference numerals S3, S4 and S5 denote O-rings in which especially the O-ring S5 is intended to form a seal between the inside and the outside of the suction pad A when the suction pad A is placed on the suction table 2.

The operation of the suction pad A of the present invention will be hereinafter described.

First of all, the steel balls 4 are arranged in all the openings 2*a* so that the negative pressure never leads to the top surface of the suction table 2. Under this condition, when the suction pad A is placed on a desired opening 2*a* of the suction table 2, the steel ball 4 within the opening 2*a* on which the suction pad A is placed is attracted by the magnet 10 into the central bore thereof. In this condition, the negative pressure from the negative pressure generating means 3 reaches the horizontal passage 5*b* via the suction bore 2*b*, the bottom-side opening 6*a* and the vertical passage 5*c*, however, does not reach the top surface 5*d* because of the top-side opening 5*a* and the outlet of the horizontal passage 5*b* being closed by the barrel 8*a* of the suction actuating pin 8.

In this condition, the suction pad A is securely fixed on the suction table 2 not only by the negative pressure from the opening 2*a* but by the attractive force of the magnet 10 acting on the steel plate 2*d* of the suction table 2. Accordingly, it is possible to prevent the suction pad A from being unintentionally moved on the suction table 2.

It is possible to selectively open only one of the openings 2*a* necessary for fixing the suction pad A and thus to reduce a chance of leakage of negative pressure. The steel ball 4 may be changed to other configuration than ball and also may be changed to other material than steel which can be attracted by the magnet 10.

When the work piece W is placed on the suction pad, the suction actuating pin 8 is pushed downward by its weight and thus the top-side opening 5*a* as well as the horizontal passage 5*b* are opened. Accordingly, the work piece W is sucked onto the suction pad A by the negative pressure supplied from the negative pressure generating means 3 via the communicating passage comprising the top-side opening 6*a*, horizontal passage 5*b*, vertical passage 5*c* and the bottom-side opening 6*a*.

Since the upper member 5 of the suction pad A is made of wood or plastics, the cutter 1*g* will never be damaged if it would contact the top surface of the suction pad A. In addition, it is easy to change the configuration of the upper member 5 made of wood or plastics so as to be adapted to the work piece W to be machined.

The work piece W can be easily taken out of the machine 1 after having been machined thereby by closing a shut-off valve (not shown) arranged on the suction duct 3 between the negative pressure generating means 3 and the opening 2*a* of the suction table 2. When the work piece W is taken out of the suction pad A, the top-side opening 5*a* is automatically closed by a return of the suction actuating pin 8 to its initial position with being urged by the spring 9.

According to the suction pad A of the present invention, since no connecting means such as the suction hose is required, troubles such as twist or tangle thereof can be eliminated.

The suction pad A can be mounted on the suction table 2 at any position thereof without using any fasteners such as bolts or guiding portions.

Although one preferred embodiment of the present invention has been described, the present invention is not limited to the illustrated embodiment. For example, the upper and lower members can be integrally formed as single body and made by one kind of material so as to reduce the manufacturing cost. In addition, the permanent magnet having rectangular configuration may be used and mounted within the bottom-side opening at any suitable position thereof.

The suction pad of the present invention can be applied to other machine tools than the wood working router machine and also applied to other work pieces than that having a plate-like configuration. In addition, the plug can be made of any magnetic attractive material such as mixture of plastic and metal powder.

What is claimed is:

1. A suction pad for a suction table having formed therein a plurality of openings connected to a negative pressure generating means and also to be able to suck and fix a work piece placed on a top surface of the suction pad, said suction pad comprising:

a communicating passage for communicating said top surface with a bottom surface of the suction pad to be placed on a top surface of the suction table and for leading the negative pressure generated by the negative pressure generating means and applied to the openings of the suction table to the top surface of the suction pad when the suction pad is placed on any one of the openings of the suction table; and a magnet for attracting a plug that blocks said one of the openings of the suction table when the suction pad is not placed on said one of the openings, said magnet attracting said plug away from said one of the openings when the suction pad is placed on said one of the openings in order to unblock said one of the openings so as to communicate the negative pressure generating means with the communicating passage.

2. A suction pad of claim 1 wherein said plug is a steel ball.

3. A suction pad of claim 1 wherein a suction actuating pin is arranged at an end of the communicating passage at the side of the top surface, the suction actuating pin closing the communicating passage when the work piece is not placed on the top surface of the suction pad and opening the communicating passage when the work piece is placed on the suction pad.

4. A suction pad of claim 1 wherein said magnet is a permanent magnet.

5. A suction pad of claim 1 wherein a top surface of the suction table is made of steel.

6. A suction pad of claim 1 wherein said suction pad is formed by an upper member of wood or plastics and a lower member of metal.

* * * * *